US011603234B1

(12) United States Patent
Paskaly

(10) Patent No.: US 11,603,234 B1
(45) Date of Patent: Mar. 14, 2023

(54) ABSORBENT DISPOSABLE DEVICE AND METHODS OF USE

(71) Applicant: Lisa Paskaly, Weaverville, NC (US)

(72) Inventor: Lisa Paskaly, Weaverville, NC (US)

( * ) Notice: Subject to any disclaimer, the term of this patent is extended or adjusted under 35 U.S.C. 154(b) by 219 days.

(21) Appl. No.: 16/939,986

(22) Filed: Jul. 27, 2020

Related U.S. Application Data

(60) Provisional application No. 62/951,650, filed on Dec. 20, 2019.

(51) Int. Cl.
*B65D 23/06* (2006.01)

(52) U.S. Cl.
CPC ..... *B65D 23/065* (2013.01)

(58) Field of Classification Search
CPC ..... B65D 2588/125; B65D 2588/02; B65D 90/0006; B65D 21/0201; B65D 88/027; B65D 88/121; B65D 88/127; B65D 90/0073; B65D 2588/12; B65D 2590/0008; B65D 2590/0041; B65D 88/022; B65D 88/12; B65G 53/36; B65G 3/00; B65G 1/04
See application file for complete search history.

(56) References Cited

U.S. PATENT DOCUMENTS 3,063,590 A * 11/1962 Peters ..... B65D 23/065 D19/1
4,437,583 A 3/1984 O'Connor
6,325,247 B1 12/2001 Iggulden
D458,380 S 6/2002 Dutil
6,401,980 B2 6/2002 Iggulden
6,718,733 B2 * 4/2004 Kilmartin ..... B65D 23/0871 53/49
6,955,272 B2 10/2005 Collins
7,128,243 B2 * 10/2006 Fallaha ..... B65D 51/185 215/246
7,192,632 B2 3/2007 Heldibridle et al.
D605,464 S 12/2009 McGuire et al.
7,926,851 B2 * 4/2011 Kaufman ..... B42D 15/00 283/81
8,298,174 B2 * 10/2012 Showers ..... A61J 7/0061 215/386
8,347,532 B1 1/2013 Johnson
8,833,611 B2 * 9/2014 Bouwer ..... B67D 1/16 215/41
D805,840 S 12/2017 Povey
D828,116 S 9/2018 Hill
(Continued)

OTHER PUBLICATIONS

"Side on Drip Catcher" found at https://www.pinterest.com.
(Continued)

*Primary Examiner* — Kareen K Thomas
(74) *Attorney, Agent, or Firm* — John Rizvi, P.A.

(57) ABSTRACT

An absorbent disposable device is provided including a body having a first end, a second end, a top edge, a bottom edge, and a first side layer and a second side layer disposed between the top edge and the bottom edge of the body. The first end and the second end of the body are selectively attachable to form a cylindrically-shaped body that provides an opening. The absorbent disposable device may be disposed over a bottleneck to absorb bottle ooze that is secreted from a bottle's spout after the bottle has been tipped for use, thereby keeping the bottleneck clean.

18 Claims, 7 Drawing Sheets

(56) References Cited

U.S. PATENT DOCUMENTS

| | | | | |
|---|---|---|---|---|
| 10,065,782 | B1 * | 9/2018 | Jones | B65D 5/42 |
| 2005/0199579 | A1 | 9/2005 | Novak | |
| 2008/0185360 | A1 | 8/2008 | Zak et al. | |
| 2008/0314924 | A1 | 12/2008 | Marr et al. | |
| 2010/0187256 | A1 | 7/2010 | Draisma | |
| 2011/0011487 | A1 | 1/2011 | Barnes | |
| 2013/0323457 | A1 * | 12/2013 | Barringer | A47K 10/02 428/134 |
| 2014/0014610 | A1 | 1/2014 | Steinberg | |
| 2014/0120287 | A1 * | 5/2014 | Jacoby | B65B 11/00 53/461 |
| 2017/0196776 | A1 | 7/2017 | Marek | |
| 2019/0084729 | A1 * | 3/2019 | Zufferey | B65D 41/62 |

OTHER PUBLICATIONS

"Cat Tongue Wine Bottle Drip Stop Collar" found at https://www.instructables.com.
"Venetto Wine cuff Drop catcher wine collar scarf drip catcher with felt black" found at https://www.etsy.com.
"WINO Wine Drip Rings" found at https://www.etsy.com.
"Wine Bottle Wrap Drip Collar Kit" found at https://www.amazon.com.
"Drip Strips: Bottle Drool Absorbers Wine Rings" found at https://www.amazon.corn.

* cited by examiner

ABSORBENT DISPOSABLE DEVICE AND METHODS OF USE

CROSS-REFERENCE TO RELATED APPLICATIONS

This application claims the benefit of U.S. Provisional Patent Application Ser. No. 62/951,650, filed on Dec. 20, 2019, which is incorporated herein in its entirety.

FIELD OF THE INVENTION

The present invention generally relates to absorbent devices, and more particularly, to an absorbent disposable device that is disposed over a bottleneck to absorb bottle ooze that flows from the bottle's spout after the bottle has been tipped over for use.

BACKGROUND OF THE INVENTION

Liquid containers have been around for hundreds of years, holding everything from purified water to gallons of petroleum drilled miles offshore. The physical characteristics of these containers vary dramatically, mirroring their function. Some have bottlenecks to comply with their intended purpose of pouring its contents elsewhere, while others have no such bottlenecks, as they are reserved for the long-term storage of a liquid or substance.

The aforementioned containers with bottlenecks are substantially more relevant to society than their counterparts due to their prevalence and everyday use. They support the pouring of liquids, such as water for drinking, olive oil for cooking, liquid detergent for washing, among many others. The widespread complaint of their design is the residual ooze that trickle down the bottle upon its usage. This offers a spectrum of nuisance depending on the type of liquid it holds and how much ooze the bottle design allows for.

Residual oozing on a bottleneck will increase the chance that the bottle slips from the grasp of the individual, especially if it stores an oily substance. Depending on the material the bottle is composed of, it may shatter on the floor, increasing the risk for injury to the individual. If the liquid is flammable, this further increases the hazard and potential for disaster.

If the liquid contained within the bottle has the potential to make the floor slippery, merely one drip of it will increase the risk of a slip and fall injury, especially among the older population. According to the Centers for Disease Control and Prevention (CDC), over one million Americans suffer a slip and fall injury, with over 17,000 of them dying from such injuries annually.

Another, not so apparent downfall, associated with residual oozing on bottlenecks, is the number of natural resources that are going to waste while attending to this slippery problem. For instance, scattered around the country are thousands of tasting rooms that deal with bottle ooze. The immediate solution is to use water, soap, and paper towel to clean the surface area of the bottleneck. Think about the tons of water, soap, and paper towel used annually to attend to this problem. Consequently, there is a massive waste of our natural resources when it comes to cleaning bottle ooze that needs to be corrected.

As a result, an attempted solution offers a container onto which the bottle is settled upon usage to collect the dripping liquid, but this fails to prevent the liquid from running down the bottle, offering increased risk of it slipping upon grasping and does nothing to alleviate the potential to stain clothing or other expensive cloths and materials.

Others promote a separate and specialized pourer to control the pouring of the liquid. However, they are only suitable to certain bottles (such as those containing wine) and not to the majority of other bottles that permit extensive oozing. The lack of a general application of these pourers generates a need for consumers to purchase different pourers for different bottles they possess, making it costly and impractical.

To prevent unnecessary disasters, and to prevent the continuous waste of our natural resources, there is an established need for a device that overcomes the limitations and drawbacks of that do not work to solve the associated problems that remain unsolved.

SUMMARY OF THE INVENTION

The present invention is directed to a convenient and cost-saving device that is capable of neatly and efficiently absorbing bottle ooze that is secreted from a bottle's spout after the bottle has been tipped for use. The absorbent device is a disposable device that may be used with an olive oil bottle, balsamic oil bottle, or any other bottle that includes an extended bottleneck, such as a wine bottle and champagne bottle.

Introducing a first embodiment of the present invention, a disposable absorbent device comprising, a body having a first end, a second end, a top edge, a bottom edge, a first side layer and a second side layer extending between the top edge and the bottom edge of the body, wherein the first end and the second end of the body are selectively attachable to form a shaped-body that provides an opening.

In another aspect, the first side layer may be superimposed on the second side layer.

In another aspect, the first side layer may include an exterior surface and an interior surface.

In another aspect, the second side layer may include an exterior surface and an interior surface.

In another aspect, the interior layer of the first side layer may be selectively attached to the exterior surface of the second side layer when the first side layer is superimposed on the second side layer.

In another aspect, the first end and the second end of the body may be stitched together.

In another aspect, the first end and the second end of the body may be glued together.

In another aspect, the form-shaped body formed may be cylindrically-shaped.

In another aspect, the diameter of the first side layer is larger than the diameter of the second side layer when the first end of the body is attached to the second end to form the cylindrically-shaped body.

In another aspect, the opening formed by the shaped-body is shaped and otherwise configured to snugly engage a bottleneck portion of a bottle therein.

In another aspect, the first side layer may be made out of cotton or linen material that is adaptable to absorb and retain fluid that oozes from the bottle's spout down the bottle neck.

In a second aspect, the second side layer may be made out of cotton or linen material that is adaptable to absorb and retain fluid that oozes from the bottle's spout down the bottle neck.

In yet another aspect, the first and second side layer may be made out of a closely woven fabric, such as percale.

In yet another aspect, the first and second side layer may be made out of a synthetic blend of material.

In another aspect, the synthetic blend of material may include 67% rayon, 28% nylon, and 5% spandex.

In another aspect, the first and the second side layers may be made out of a resilient material.

Introducing a second embodiment, a disposable absorbent device comprising, a body having a first end, a second end, a first side layer between a top edge and a bottom edge, wherein the body is foldable about a hinge line such that the top edge is aligned with the bottom edge of the body to form a doubled layer body that is selectively attachable to a bottleneck of a bottle.

Introducing yet another embodiment, a method of using a disposable absorbent device comprising the steps of:

providing a disposable absorbent device that includes a cylindrically-shaped body having a first side layer superimposed over a second side layer, the cylindrically-shaped body having an opening;

providing a bottle having a bottleneck;

inserting the bottleneck of the bottle through the opening of the disposable absorbent device until a bottom edge of the device's body makes contact with the bottle's shoulder; and disposing the disposable absorbent device after continuous use has saturated the first and second layers of the body with fluid.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient and cost-saving device that is capable of neatly and efficiently absorbing bottle ooze that is secreted from a bottle's spout after the bottle has been tipped over for use. The absorbent device is a disposable device that may be used with a bottle, such as an olive oil bottle, balsamic oil bottle, or any other type of bottle that include an extended bottleneck.

Figure 1:
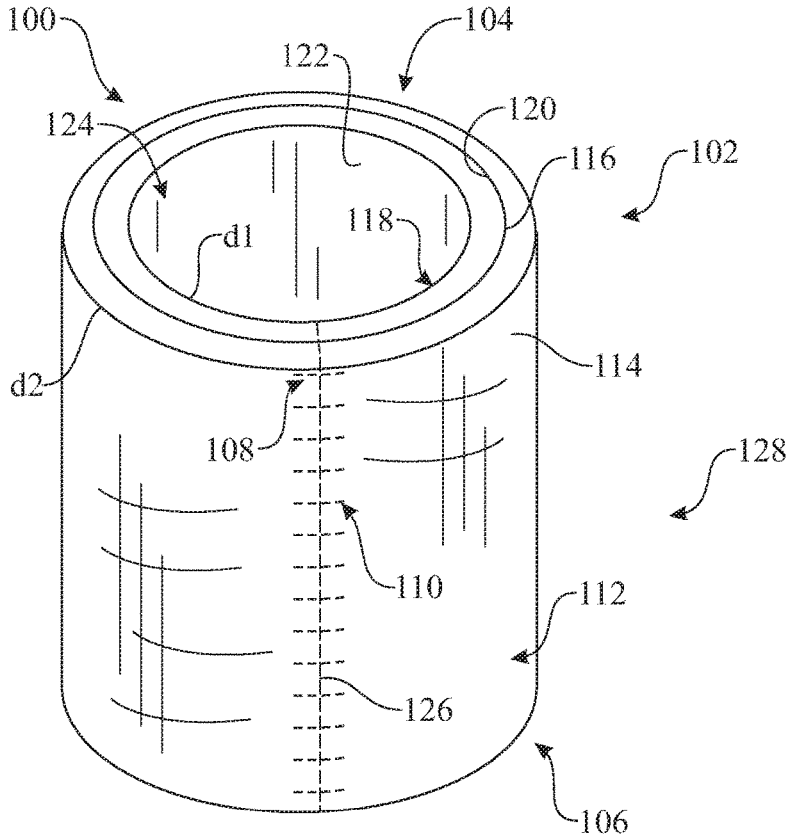
FIG. 1 presents a perspective view showing a first embodiment of the absorbent disposable of the present invention.
Figure 2:
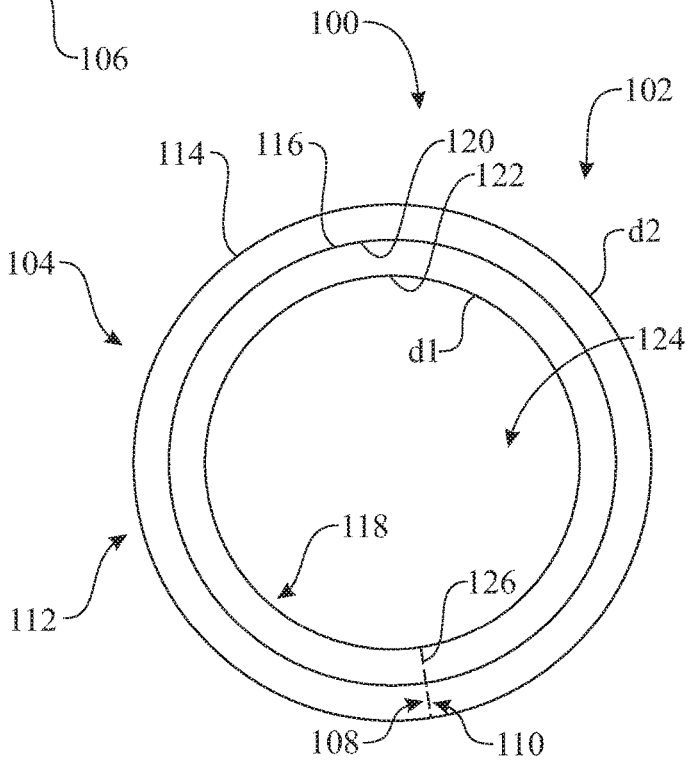
FIG. 2 presents a top view of the first embodiment of the absorbent disposable device of the present invention.

Referring initially to FIGS. 1 and 2, a disposable absorbent device 100 is generally shown in accordance with a first embodiment of the present invention. The disposable absorbent device 100 (hereinafter "absorbent device") generally comprises a shaped-body 102 having a top edge 104, a bottom edge 106, a first end 108, and a second end 110. A first side layer 112 and a second side layer 118 are disposed between the top edge 104 and bottom edge 106 of the body, terminating at the first and second end 108, 110 thereof. The shaped-body 102 of the absorbent device 100 may be provided in rectangular form. Alternative shapes, however, may be employed without departing from the scope of the invention.

With continued reference to FIGS. 1 and 2, the first side layer 112 of the absorbent device 100 includes an exterior surface 114 and an interior surface 116 opposite thereto. The first side layer 112 of the absorbent device 100 may be made out of any suitable resilient material having the capacity or tendency to absorb a substance, such as fluids. For instance, the first side layer 112 may be made out of a natural fiber that has been woven or knitted into a fabric with a high thread count, such as percale. Some of the natural fibers that may be used include but are not limited to, cotton, wool, and linen. In an alternative embodiment, the first side layer 112 may be made out of a synthetic blend that includes, but is not limited to rayon, nylon, and spandex. In one exemplary form, the proportions of material of the synthetic blend may comprise 67% rayon, 28% nylon, and 5% spandex. Thus, it should be readily understood that the first side layer 112 of the absorbent device 100 may include any material that has a high absorbent rate, strong fluid locking ability, and is non-toxic.

The second side layer 114 of the absorbent device 100 includes an exterior surface 118 and an interior surface 120 opposite thereto. Similar to the first side layer 112, the second side layer 114 may be made out of any suitable resilient material having the capacity or tendency to absorb a substance, such as fluids. The second side layer 114 may be made out of a natural woven fiber, such as cotton, linen, or wool to make a specialized woven fabric, such as percale. In an alternative embodiment, the second side layer 114 may be made out of a synthetic blend that includes, but is not limited to rayon, nylon, and spandex. Thus, the second side layer 114 may also include any material that has a high absorbent rate, strong fluid locking ability, and is non-toxic.

Figure 7:
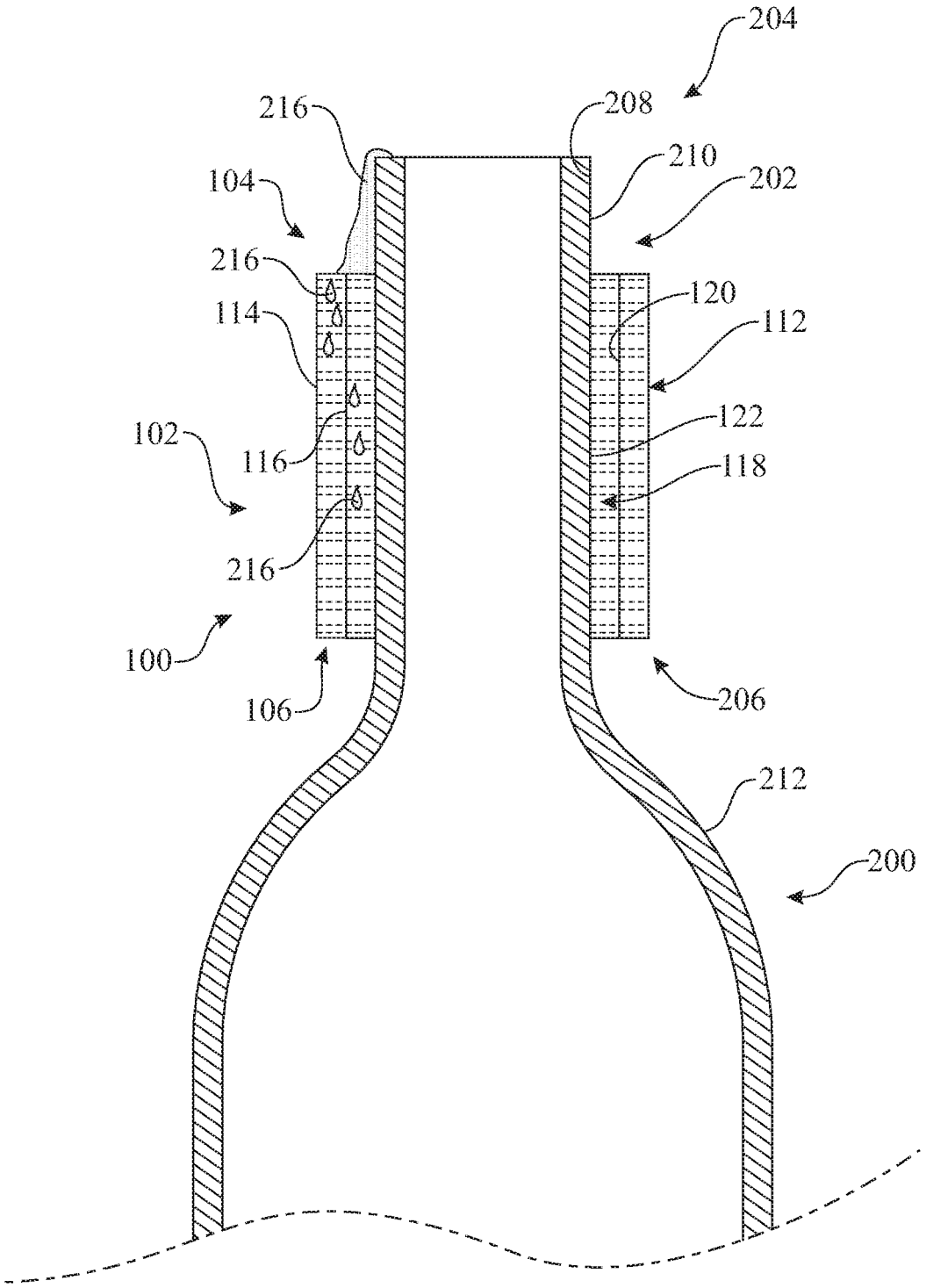
FIG. 7 presents a cross-sectional view of the absorbent disposable device that is disposed over the bottleneck of the bottle and is absorbing fluid that is oozing from the spout of the bottle, the cross-section taken from section line 7-7 shown on FIG. 6.

Referring now to FIGS. 2 and 7, the first layer 112 of the absorbent device 100 may be superimposed over the second layer 114 of the absorbent device 100, and attached thereto. While the first layer can be attached to the second layer via a plurality of methods, for the sake of brevity only two will be described further herein below. The first exemplary method of attaching the first side layer 112 to the second side layer 114 includes adding an adhesive film over the interior surface 116 of the first side layer 112 and the exterior surface 120 of the second side layer 114. When both the first side layer 112 is superimposed over the second side layer 114, and the interior surface 116 of the first side layer 112 connects with the exterior surface 120 of the second side layer 114, the adhesive films on both surfaces stick to one another forming an inseparable mechanical bond. The adhesive film may also form a partition that creates two separate layers that are readily available to absorb and retain fluid therein.

The second exemplary method of attaching the first side layer 112 to the second side layer 114 of the absorbent device 100 includes stitching, joining, sewing, or mending the two side layers together. The first and second layer may be stitched together by superimposing the first layer over the second layer such that the interior surface 116 of the first side layer 112 makes contact with the exterior surface 120 of the second side surface 114 before the two side layers are stitched with a needle and thread. Again, there are a plurality of methods that may be employed to attached the first and second layer together, thus the foregoing methods should be interpreted as exemplary methods of attachment and not be considered as limiting.

Turning now to FIGS. 1 and 2, the rectangular shaped-body 102 of the absorbent device 100 may be shaped or otherwise devised to engage the bottleneck portion 202 of a bottle 200. In one exemplary form, the shaped-body 102 may be shaped in the form of a cylindrical body 128 that includes an opening 124. While the absorbent device 100 is shaped in cylindrical form, the cylindrical body having a multi-layered side surface includes an interior diameter d1 formed by the second side layer 114 that is smaller than the exterior diameter d2 of the first side layer formed by the first side layer 112. The forming of the cylindrical body 128 may be done by attaching or bonding the first end 108 to the second end 110 of the body 102. As shown in FIG. 1, the first end 108 of the body may be attached to the second end 110 with stiches 126. Alternative means to attach both ends (e.g., via an adhesive), however, may be used without departing from the scope of the invention.

Referring now to FIGS. 3-7, an exemplary method of operational use of the absorbent device 100 is now described.

Figure 3:
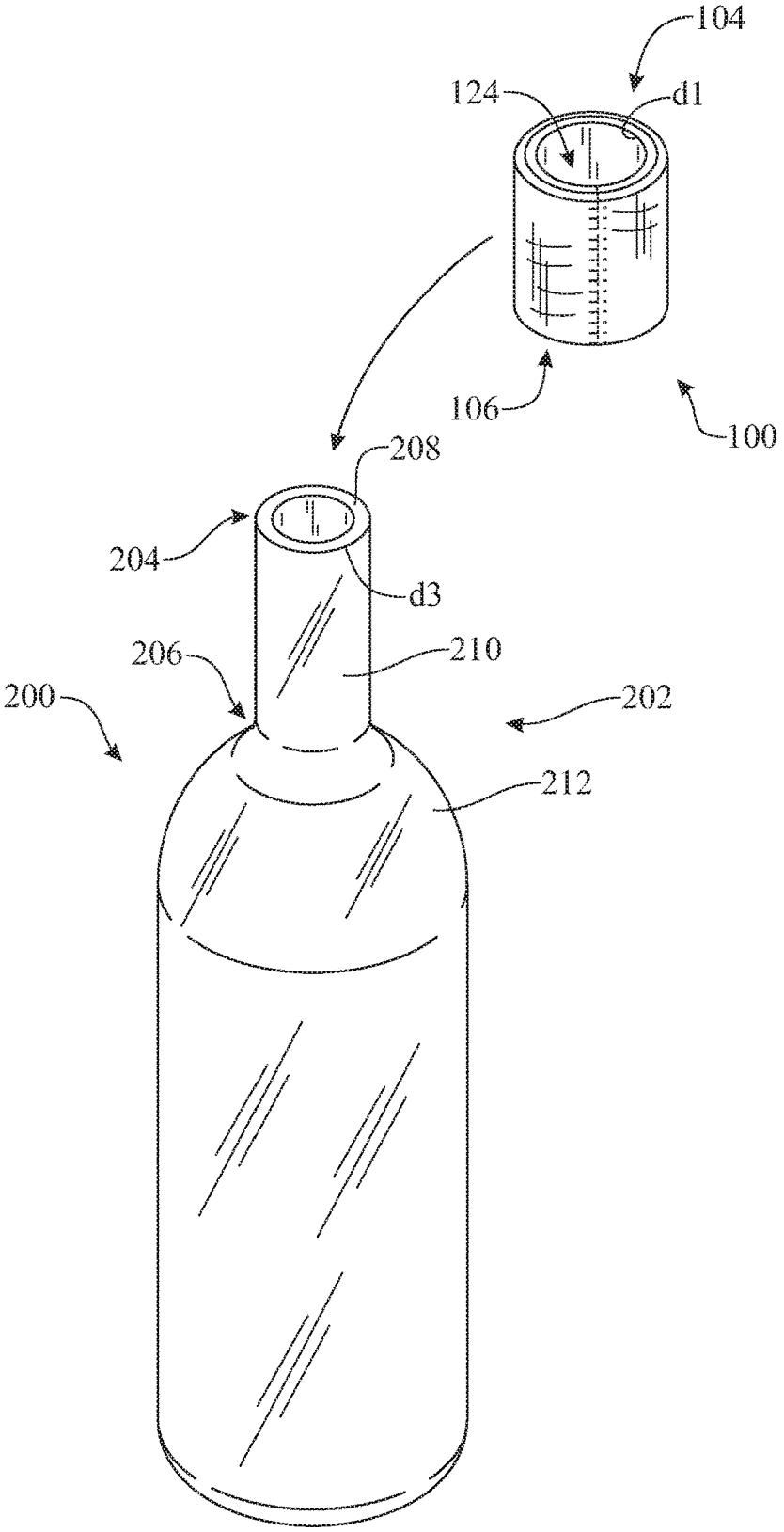
FIG. 3 presents a perspective view showing how the absorbent disposable device may engage the bottleneck of a bottle.
Figure 4:
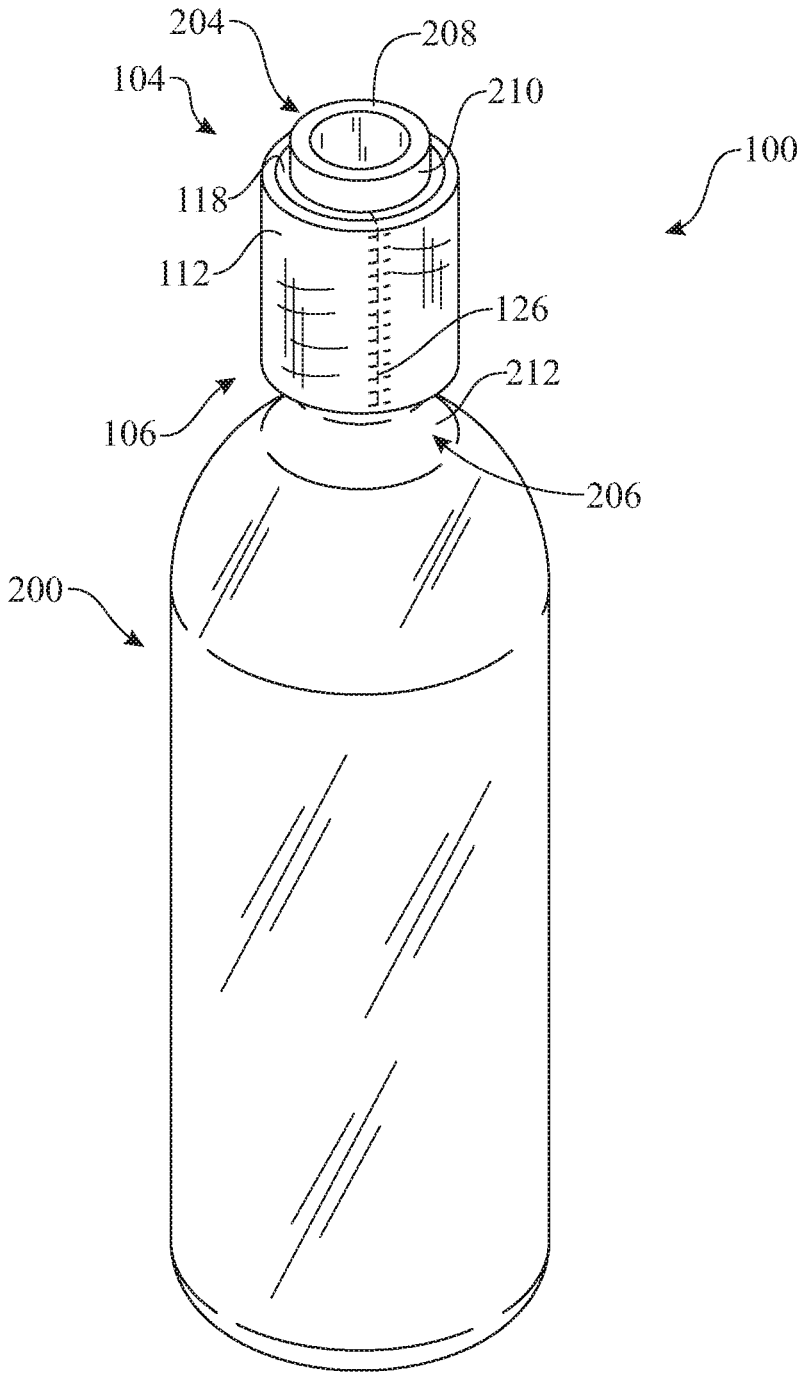
FIG. 4 presents a perspective view of the absorbent disposable device disposed over the bottleneck of the bottle.

With reference to FIGS. 3 and 4, after the first and second end 108, 100 of the shaped body 102 have been attached to form a cylindrical body 128 with an opening 124, the absorbent device 100 is ready to be used. The inner diameter d1 of the absorbent device 100 is slightly smaller than the outer diameter d3 of the bottleneck. Because of the difference in diameters, the resilient body 102 of the absorbent device is slightly stretched so that the opening 124 of the absorbent device 100 is enlarged to become slightly bigger than the diameter d3 of the bottleneck 202. Following the enlargement of the opening 124, the user (not shown) inserts the top end 204 of the bottleneck 202 through the opening 124 of the absorbent device until the bottom edge 106 of the absorbent device is proximate to the bottom end of the bottleneck where the shoulders 212 of the bottle 200 begin. It should be readily apparent, however, that the size of the absorbent device 100 may vary such that the bottom edge of the device may not reach the shoulders of the bottle. In an alternative embodiment, the device may go past the shoulders of the bottle. Thus, the foregoing description should be interpreted as exemplary.

Turning quickly to FIG. 7, after the absorbent device is stretched to enlarge the opening 124 so that the bottleneck 202 of the bottle 200 fits within the opening, the absorbent device recovers or springs back to its original state, resulting in the device tightening itself to the bottleneck 202. While disposed around the bottleneck 202 of the bottle 200, the interior surface 122 of the second side layer 114 makes contact with the bottleneck 202, thereby creating a seal around the bottleneck. Meaning, any fluid that runs or oozes down the bottleneck makes contact with the absorbent device 100.

Figure 5:
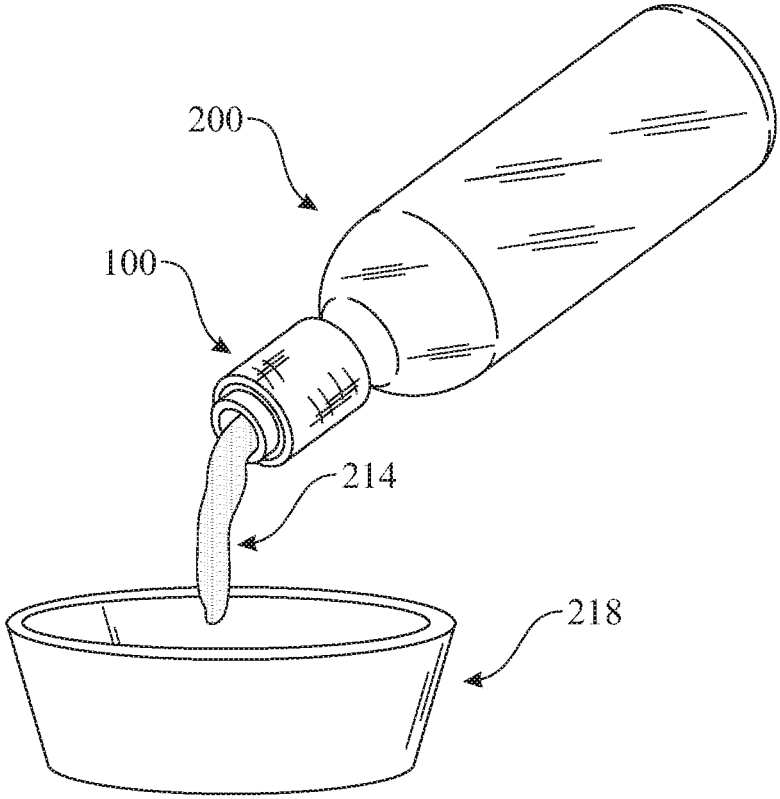
FIGS. 5 and 6 presents a perspective view of a bottle that is tipped for use and returned to its upright position illustrating how bottle ooze flows from the bottle's spout down the bottle's neck.
Figure 6:
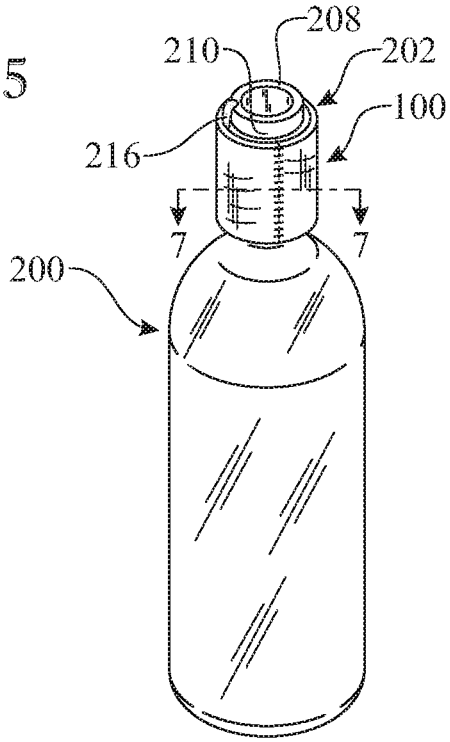

With reference now to FIGS. 5-7, the figures illustrate how the absorbent device 100 absorbs bottle ooze. As is best shown in FIG. 5, after the absorbent device 100 is disposed around the bottleneck 202 of the bottle 200, the bottle 200 may be regularly used. Using the bottle may consist of tilting the bottle until the fluid content 214 inside of the bottle flows from the bottle's spout 208 and generally into a container 218. Once the bottle is returned to its upright position (as shown in FIG. 6), it is normal for residual fluid content 216 to flow or trickle from the bottle's spout 208 down the wall surface 210 of the bottleneck 202. Turning now to FIG. 7, the fluid 216 trickling down the wall surface 210 of the bottleneck 202 continues until it reaches the absorbent device 100 disposed around the bottleneck 202. As is best illustrated, the body's first and second side layer 112, 114 work in unison to absorb all of the fluid or ooze that trickles down the bottle's spout 208. In one exemplary form, after the second side layer 114 has become saturated with fluid, the first side layer 112 absorbs the residual fluid that can longer be absorbed by the second side layer 114. Once the first side layer 112 is saturated with fluid 216, the absorbent device may be removed from the bottleneck 202 of the bottle 200 and disposed of. A separate absorbent device 100 may then be disposed over the bottleneck 202 of the bottle 200 through similar means as have been described heretofore and the process of usage is repeated. In a preferred mode of use, it is contemplated that the absorbent device 100 be used to absorb any residual fluid or ooze that is produced from about 75 to 100 pours of the bottle before it is disposed of and a new absorbent device 100 is donned over the bottleneck of the bottle, Turning now to FIGS. 8-10, an alternative embodiment of the disposable absorbent device 300 is generally shown in accordance with the present invention. The disposable absorbent device 300 (hereinafter "absorbent device") generally comprises a shaped-body 302 having a top edge 304, a bottom edge 306, a first end 308, and a second end 310. A first side layer 312 is disposed between the top edge 304 and bottom edge 306 of the body 102. The shaped-body 302 of the absorbent device 100 may be provided in a plurality of forms. However, in a preferred embodiment, the absorbent device is provided in a rectangular shaped body.

The first side layer 312 of the absorbent device 300 includes an exterior surface 314 and an interior surface 316 opposite thereto, and includes a hinge line 318 at about a middle distance between the top edge 304 and the bottom edge 306. The first side layer 312 of the absorbent device 300 may be made out of any suitable resilient material having the capacity or tendency to absorb a substance, such as fluids. For instance, the first side layer 312 may be made out of a natural fiber that has been woven or knitted into a fabric with a high thread count, such as percale. Some of the natural fibers that may be used include but are not limited to, cotton, wool, and linen. In an alternative embodiment, the absorbent device 300 may be made out of a synthetic blend that includes, but is not limited to rayon, nylon, and spandex. Thus, it is contemplated that the absorbent device 100 may include any material that has a high absorbent rate, strong fluid locking ability, and is non-toxic.

Figure 8:
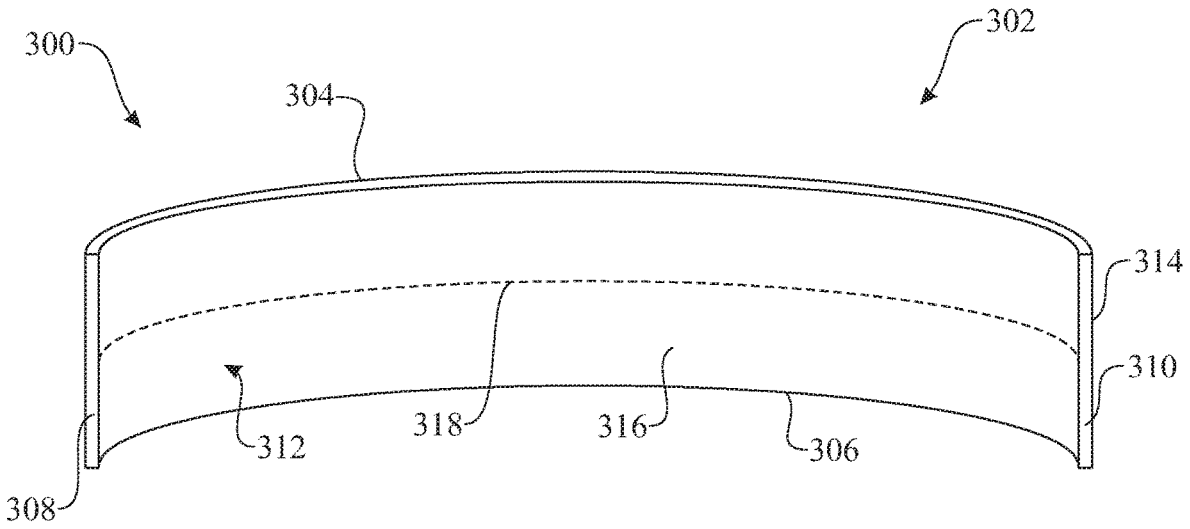
FIG. 8 presents a perspective view of a second embodiment of the absorbent disposable device of the present invention.
Figure 9:
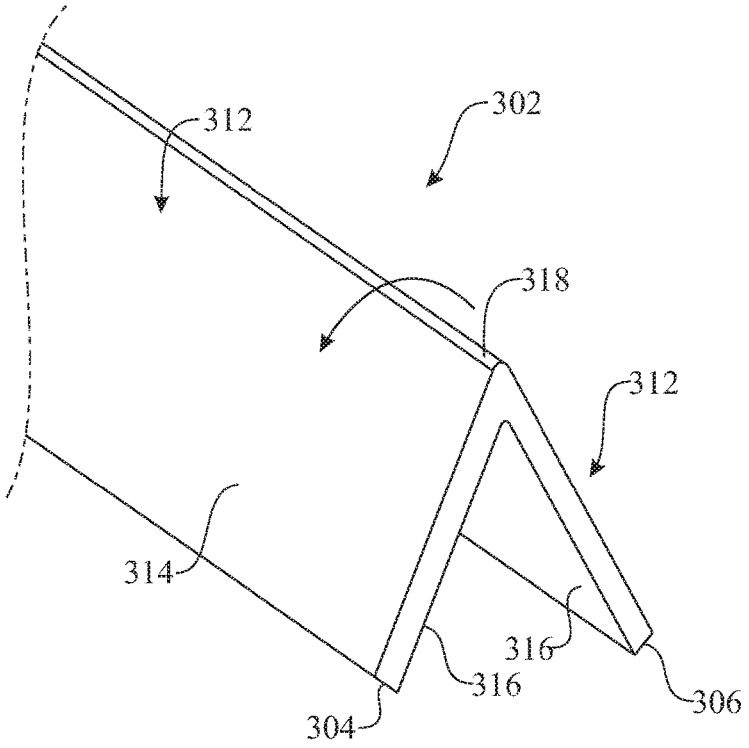
FIG. 9 presents a perspective view of the second embodiment of the absorbent disposable device of the present invention being folded about a hinge line.

With continued reference to FIGS. 8 and 9, the first side layer 312 of the absorbent device 100 may be folded to form an absorbent device with at least two side layers. This may be done in one exemplary form by folding the first side layer 312 of the absorbent device 300 about hinge line 318, and aligning the top edge 304 to the bottom edge 306 of the absorbent device 300. This creates a first side layer 312 superimposed over a second side layer 312. The top edge 304 and bottom edge 306 of the absorbent device 300 may be joined or attached together. In one exemplary form, both the top edge 304 and bottom edge 306 may be attached through stitching. Alternatively, the top edge 304 and bottom edge 306 of the absorbent device 300 may be joined with the use of an adhesive that permanently joins the two edges together. In an alternative embodiment (not shown), the absorbent device may be folded about a vertical hinge line located about the body's center (i.e., halfway between the body's first end and second end). Folding the body forms a first side layer superimposed over a second side layer. After the body has been folded, the first end and the second end of the body can be selectively attached or joined together. As is best understood, when folding the device body about the vertical hinge line instead of the horizontal hinge line 318 (illustrated in FIG. 8), the length of the device body is diminished in size by one-half but its height remains unchanged. When the device body is folded about the horizontal hinge line 318, the height of the device body is diminished in size by one-half but its length remains unchanged.

Figure 10:
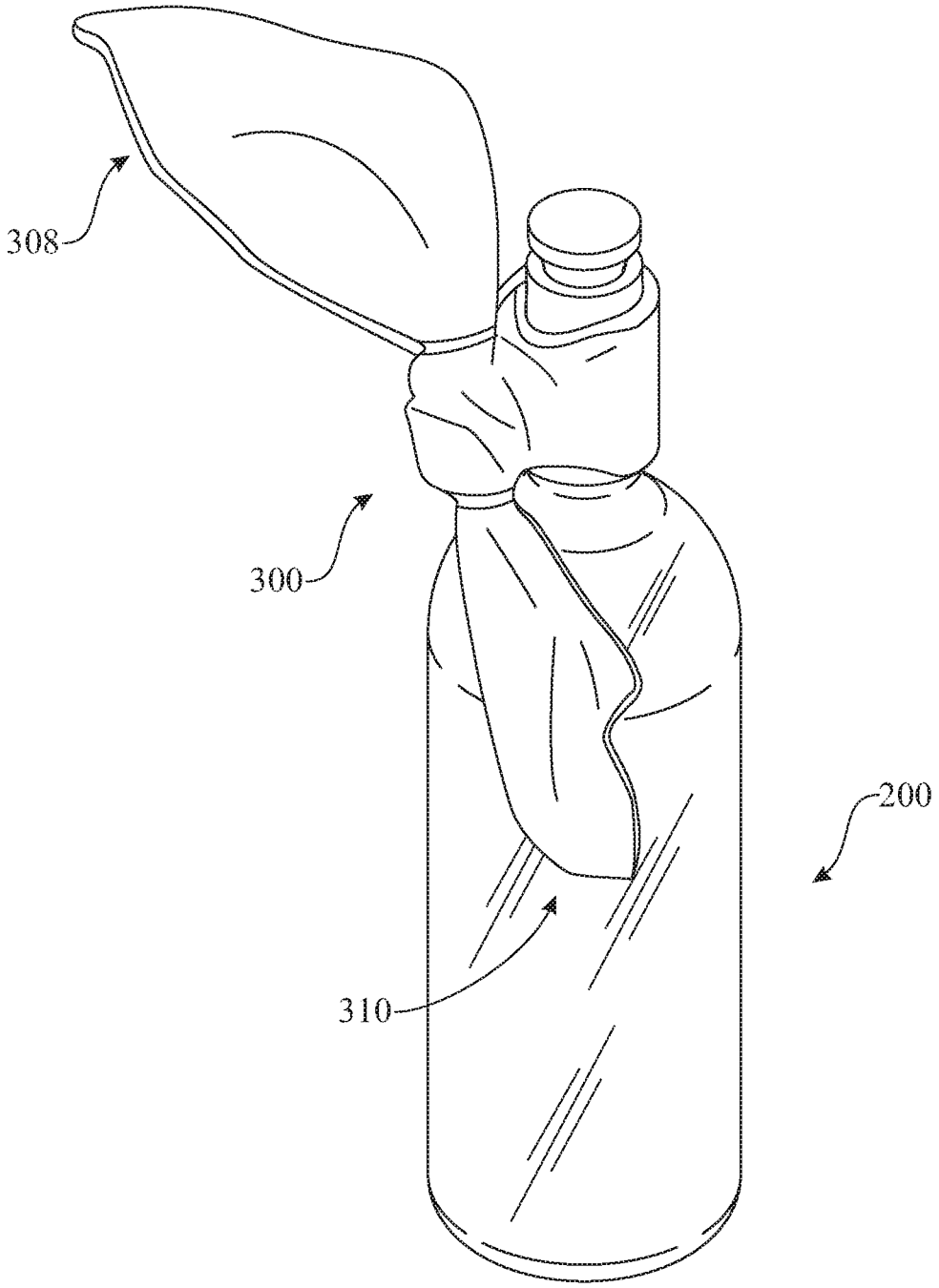
FIG. 10 presents a perspective view of the second embodiment of the absorbent disposable device of the present invention that is wrapped and tied to the bottleneck of a bottle.

Referring now to FIG. 10, after the absorbent device 300 is folded about hinge line 318 and the first side layer 312 forms at least two side layers and the top edge and bottom edge of the device are attached, the absorbent device 300 may be disposed over the bottleneck of a bottle. In one exemplary form, the absorbent device may be wrapped around the bottleneck covering the neck in its entirety before the first and second end are used to tie or secure the absorbent device to the bottleneck. The first and second end 308, 310 of the absorbent device may be interlaced, looped, or otherwise linked to form a decorative bow that secures the absorbent device 300 to the bottle.

After the absorbent device 300 is disposed around the bottleneck of the bottle 200, the bottle 200 may be regularly used. As described herein above, using the bottle may consist of tilting the bottle until the fluid content inside of the bottle flows from the bottle's spout and generally into a container. Once the bottle is returned to its upright position, it is typical for residual fluid content to flow or trickle from the bottle's spout down the wall surface of the bottleneck. The fluid trickling down the wall surface of the bottleneck continues until it reaches the absorbent device 300 disposed around the bottleneck. The absorbent first and second side layer work in unison to absorb all of the fluid or ooze that trickles down the bottle's spout. Once the absorbent device 300 becomes saturated with fluid, the absorbent device may be removed from the bottleneck of the bottle 200 and disposed of. A separate absorbent device 300 may then be disposed over the bottleneck of the bottle through similar means as have been described heretofore and the process of usage is repeated. It is contemplated that the absorbent device 300 be used to absorb any residual fluid or ooze that is produced from about 75 to 100 pours of the bottle before it is disposed of, and a new absorbent device 300 is donned over the bottleneck of the bottle. That means that an absorbent device can be disposed on a bottle for weeks, perhaps, months before it must be disposed of. For wine bottles, the absorbent device can be used and reused with about 10 to about 15 bottles before having to be disposed of, or in some cases washed.

In summary, the absorbent device in a preferred embodiment is disposable. Although the absorbent device is providable in washable material, being disposable is preferred because it reduces or otherwise eliminates the need to use unnecessary amounts of water, soap, and drying material, such as paper towels, to cleanse the device. The absorbent device is a unique and simple, yet effective, solution to a problem that continues to persist. Moreover, the absorbable device eliminates the need for a person to spend hours cleaning bottles every evening after a shift, reducing labor costs. The device also makes the handling of bottles that contain fluids that ooze on to the bottleneck easier and safer to handle. Instead of having to worry about the surface area of the bottle and it being difficult to handle and easy to slip from one's hand, the disposable device maintains a clean, easily grippable surface area around the body and bottle neck of the bottle minimizing the chances of an accident.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A reusable absorbent device, comprising:

a body having a first end, a second end, a first side layer and a second side layer extending between the first end and the second end, wherein the first end and the second end of the body are selectively attachable to form a shaped-body providing a central opening, wherein the shaped-body is disposable over a bottleneck, and wherein the first side layer and the second side layer are made out of a synthetic blend material comprising about 67% rayon, 28% nylon, and about 5% spandex.

2. The reusable absorbent device of claim 1, wherein the first layer and the second layer are superimposed.

3. The reusable absorbent device of claim 1, wherein an interior surface of the first side layer is attached to an exterior surface of the second side layer.

4. The reusable absorbent device of claim 1, wherein the first side layer and the second side layer include two opposite ends and to opposite sides, the opposite sides of each layer being longer in length than the two opposite ends.

5. The reusable absorbent device of claim 1, wherein the first side layer and the second side layer are glued together.

6. The reusable absorbent device of claim 1, wherein the first side layer and the second side layer are stitched together about a perimeter edge.

7. The reusable absorbent device of claim 1, wherein the opening of the shaped-body is configured to fit snugly over the bottleneck of a bottle.

8. The reusable absorbent device of claim 1, wherein at least one of the first side layer and the second side layer is made out of an absorbable material that retains fluid oozing down the bottle neck.

9. The reusable absorbent device of claim 1, wherein a bottom portion of the shaped-body rests on a shoulder portion connected to the bottleneck.

10. The reusable absorbent device of claim 1, wherein the first side layer and the second side layer are made out of a closely woven fabric.

11. The reusable absorbent device of claim 1, wherein at least one of the first side layer and the second side layer are made out of a resilient material.

12. The reusable absorbent device of claim 1, wherein the reusable absorbent device disposed over the bottleneck of a bottle is usable between about 75 to 100 pours before becoming saturated with fluid and being disposed of.

13. The reusable absorbent device of claim 1, wherein the shaped-body is cylindrically-shaped.

14. A reusable absorbent device, comprising:

a body having a first end, a second end, a first side layer extending between a top edge and a bottom edge, wherein the body is foldable about a hinge lie such that the top edge is alignable with the bottom edge of the body to form a double layered body that is selectively attachable to a bottleneck of a bottle, and wherein the reusable absorbent device attachable to the bottle neck of a bottle is usable between about 75 to 100 pours before becoming saturated with fluid and being disposed of.

15. The reusable absorbent device of claim 14, wherein the body is made out of an absorbable material that retains fluid oozing down the bottle neck.

16. The reusable absorbent device of claim 15, wherein the absorbable material is a closely woven fabric.

17. A method of using a reusable absorbent device, comprising the steps of:

providing a reusable absorbent device that includes a cylindrically-shaped body having a first end, a second end, and a first side layer superimposed over a second side layer, the cylindrically-shaped body providing a central opening, wherein the first side layer and the second side layer are made out of a synthetic blend material comprising about 67% rayon, 28% nylon, and about 5% spandex;

providing a bottle having a bottleneck;

inserting the bottleneck of the bottle through the central opening of the disposable absorbent device until a bottom edge of the cylindrical-shaped body of the absorbent device makes contact with the bottle's shoulder; and disposing the reusable absorbent device after continuous use has saturated the first and second layers of the body with fluid.

18. A reusable absorbent device, comprising:

a body having a first end, a second end, a first side layer and a second side layer extending between the first end and the second end, wherein the first end and the second end of the body are selectively attachable to form a shaped-body providing a central opening, wherein the shaped-body is disposable over a bottleneck, and wherein the reusable absorbent device disposed over the bottleneck of a bottle is usable between about 75 to 100 pours before becoming saturated with fluid and being disposed of.

* * * * *